US009441440B2

(12) United States Patent
Hofman et al.

(10) Patent No.: US 9,441,440 B2
(45) Date of Patent: Sep. 13, 2016

(54) DOWNHOLE TOOLS, SYSTEM AND METHOD OF USING

(71) Applicant: Peak Completion Technologies, Inc., Midland, TX (US)

(72) Inventors: Raymond Hofman, Midland, TX (US); William Sloane Muscroft, Midland, TX (US); Eric Fruge, Houston, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 288 days.

(21) Appl. No.: 14/147,141

(22) Filed: Jan. 3, 2014

(65) Prior Publication Data

US 2014/0116721 A1 May 1, 2014

Related U.S. Application Data

(63) Continuation-in-part of application No. 13/462,810, filed on May 2, 2012, now Pat. No. 9,133,684.

(60) Provisional application No. 61/748,703, filed on Jan. 3, 2013, provisional application No. 61/481,483, filed on May 2, 2011.

(51) Int. Cl.

| | |
|---|---|
| ***E21B 34/12*** | (2006.01) |
| ***E21B 34/14*** | (2006.01) |
| ***E21B 33/00*** | (2006.01) |
| ***E21B 23/00*** | (2006.01) |
| ***E21B 34/06*** | (2006.01) |
| ***E21B 34/10*** | (2006.01) |

(52) U.S. Cl.

CPC ..... *E21B 33/00* (2013.01); *E21B 23/00* (2013.01); *E21B 34/063* (2013.01); *E21B 34/103* (2013.01)

(58) Field of Classification Search

CPC ..... E21B 43/26; E21B 34/103; E21B 34/12; E21B 34/14

USPC ..... 166/318, 319, 334.4

See application file for complete search history.

(56) References Cited

U.S. PATENT DOCUMENTS

| | | | | |
|---|---|---|---|---|
| 2,251,977 | A | 8/1941 | Burt | |
| 4,515,217 | A | 5/1985 | Strout | |
| 4,609,005 | A | 9/1986 | Upchurch | |
| 5,261,486 | A | 11/1993 | Cornette et al. | |
| 6,079,496 | A * | 6/2000 | Hirth | E21B 34/14 166/321 |
| 6,286,594 | B1 | 9/2001 | French | |
| 6,293,342 | B1 | 9/2001 | McGarian et al. | |
| 6,464,008 | B1 | 10/2002 | Roddy et al. | |
| 6,729,393 | B2 * | 5/2004 | Vincent | E21B 21/103 166/177.4 |
| 7,021,389 | B2 * | 4/2006 | Bishop | E21B 34/14 166/317 |

(Continued)

*Primary Examiner* — Kenneth L Thompson

(57) ABSTRACT

A downhole tool comprising a nested sleeve moveable from a closed position to an open position following actuation of a fluid control device. The fluid control device may selectively permit fluid flow, and thus pressure communication, into the annular space to cause a differential pressure across the shifting sleeve, and thereby moving the shifting sleeve to an open position. A static plug seat is positioned in the tubing or casing upwell of the downhole tool. When the shifting sleeve is opened, fluid flow is established through the static plug seat, allowing a dissolvable or disintegrable ball or other plug to engage the plug seat, preventing fluid flow past the plug seat to the opened downhole tool, thereby permitting pressurization of the tubing or casing, such as for a pressure test. Disintegration of the ball allows fluid communication to be re-established with the downhole tool, permitting fluid to flow through the tubing for subsequent operations.

19 Claims, 9 Drawing Sheets

(56) References Cited

U.S. PATENT DOCUMENTS

| | | | | |
|---|---|---|---|---|
| 7,055,598 | B2 | 6/2006 | Ross et al. | |
| 7,775,285 | B2 * | 8/2010 | Surjaatmadja | E21B 34/14 166/222 |
| 7,866,402 | B2 | 1/2011 | Williamson, Jr. | |
| 7,909,095 | B2 | 3/2011 | Richards et al. | |
| 7,926,573 | B2 | 4/2011 | Swan et al. | |
| 8,096,363 | B2 | 1/2012 | Williamson, Jr. | |
| 8,267,178 | B1 | 9/2012 | Sommers et al. | |
| 8,365,829 | B2 * | 2/2013 | Kellner | E21B 23/02 166/193 |
| 2002/0166665 | A1 | 11/2002 | Vincent et al. | |
| 2005/0072575 | A1 | 4/2005 | Yeo et al. | |
| 2007/0272411 | A1 | 11/2007 | Lopez De Cardenas et al. | |
| 2008/0302538 | A1 | 12/2008 | Hofman | |
| 2009/0095463 | A1 | 4/2009 | Swan et al. | |
| 2009/0095486 | A1 | 4/2009 | Williamson, Jr. | |
| 2010/0314562 | A1 | 12/2010 | Bisset | |
| 2011/0174491 | A1 | 7/2011 | Ravensbergen et al. | |
| 2012/0181032 | A1 * | 7/2012 | Naedler | E21B 43/26 166/308.1 |
| 2013/0056220 | A1 * | 3/2013 | Sommers | E21B 34/102 166/373 |
| 2015/0330185 | A1 * | 11/2015 | Hughes | E21B 34/12 166/318 |

* cited by examiner

DOWNHOLE TOOLS, SYSTEM AND METHOD OF USING

CROSS-REFERENCES TO RELATED APPLICATIONS

This nonprovisional application claims the benefit of and priority to U.S. provisional application Ser. No. 61/748,7803, filed Jan. 3, 2013 and entitled "Downhole Tools, System and Method" and is a continuation-in-part of U.S. patent application Ser. No. 13/462,810, filed on May 2, 2012 entitled "Downhole Tool" which claims priority to U.S. provisional patent application Ser. No. 61/481,483 filed on May 2, 2011; each of which is incorporated by reference as if fully set forth herein.

STATEMENT REGARDING FEDERALLY SPONSORED RESEARCH OR DEVELOPMENT

Not applicable.

BACKGROUND

1. Field of the Invention

The described embodiments and invention as claimed relate to oil and natural gas production. More specifically, the embodiments described herein relate to a downhole tool system and method used to selectively pressurize and test a production string or casing and activate a tool in response to fluid pressure.

2. Description of the Related Art

In completion of oil and gas wells, tubing is often inserted into the well to function as a flow path for treating fluids into the well and for production of hydrocarbons from the well. Such tubing may help preserve casing integrity, optimize production, or serve other purposes. Such tubing may be described or labeled as casing, production tubing, liners, tubulars, or other terms. The term "tubing" as used in this disclosure and the claims is not limited to any particular type, shape, size or installation of tubular goods.

To fulfill these purposes, the tubing must maintain structural integrity against the pressures and pressure cycles it will encounter during its functional life. To test this integrity, operators will install the tubing with a closed "toe"—the end of the tubing furthest from the wellhead—and then subject the tubing to a series of pressure tests. These tests are designed to demonstrate whether the tubing will hold the pressures for which it was designed.

One detriment to these pressure tests is the necessity for a closed toe. After pressure testing, the toe must be opened to allow for free flow of fluids through the tubing so that further operations may take place. While formation characteristics, cement, or other factors may still restrict fluid flow, the presence of such factors do not alleviate the desirability or necessity for opening the toe of the tubing. Commonly, the toe is opened by positioning a perforating device in the toe and either explosively or abrasively perforating the tubing to create one or more openings. Perforating, however, requires additional time and equipment that increase the cost of the well. Therefore, there exists a need for an improved method to economically pressure test the tubing and open the toe of the tubing after it is installed and pressure tested.

The present disclosure describes improved devices, systems and methods for pressure testing the tubing and opening the toe of tubing installed in a well. Further, the devices, systems and methods may be readily adapted to other well applications as well.

SUMMARY OF PREFERRED EMBODIMENTS

The described embodiments of the present disclosure address the problems associated with the closed toe required for pressure testing tubing installed in a well. Further, in one aspect of the present disclosure, a chamber, such as a pressure chamber, air chamber, or atmospheric chamber, is in fluid communication with at least one surface of the shifting element of the device. The chamber is isolated from the interior of the tubing such that fluid pressure inside the tubing is not transferred to the chamber. A second surface of the shifting sleeve is in fluid communication with the interior of the tubing. Application of fluid pressure on the interior of the tubing thereby creates a pressure differential across the shifting element, applying force tending to shift the shifting element in the direction of the pressure chamber, atmospheric chamber, or air chamber.

In a further aspect of the present disclosure, the shifting sleeve is encased in an enclosure such that all surfaces of the shifting element opposing the chamber are isolated from the fluid, and fluid pressure, in the interior of the tubing. Upon occurrence of some pre-determined event—such as a minimum fluid pressure, the presence of acid, or electromagnetic signal—at least one surface of the shifting element is exposed to the fluid pressure from the interior of the tubing, creating differential pressure across the shifting sleeve. Specifically, the pressure differential is created relative to the pressure in the chamber, and applies a force on the shifting element in a desired direction. Such force activates the tool.

While specific predetermined events are stated above, any event or signal communicable to the device may be used to expose at least one surface of the shifting element to pressure from the interior of the tubing.

In a further aspect, the downhole tool comprises an inner sleeve with a plurality of sleeve ports. A housing is positioned radially outwardly of the inner sleeve, with the housing and inner sleeve partially defining a space radially therebetween. The space, which is preferably annular, is occupied by a shifting element, which may be a shifting sleeve. A fluid path extends between the interior flowpath of the tool and the space. A fluid control device, which is preferably a burst disk, occupies at least portion of the fluid path.

When the toe is closed, the shifting sleeve is in a first position between the housing ports and the sleeve ports to prevent fluid flow between the interior flowpath and exterior of the tool. A control member is installed to prevent or limit movement of the shifting sleeve until a predetermined internal tubing pressure or internal flowpath pressure is reached. Such member may be a fluid control device which selectively permits fluid flow, and thus pressure communication, into the annular space to cause a differential pressure across the shifting sleeve. Any device, including, without limitation, shear pins, springs, and seals, may be used provided such device allows movement of the shifting element, such as shifting sleeve, only after a predetermined internal tubing pressure or other predetermined event occurs. In a preferred embodiment, the fluid control device will permit fluid flow into the annular space only after it is exposed to a predetermined differential pressure. When this differential pressure is reached, the fluid control device allows fluid flow, the shifting sleeve is moved to a second position, the toe is opened, and communication may occur through the housing and sleeve ports between the interior flowpath and exterior flowpath of the tool.

In a further aspect of this disclosure, a static plug seat, such as a ball seat, is positioned in the tubing above the downhole tool and dimensioned to receive an appropriate plug, such as a properly sized ball. The static plug seat and received plug operate to seal the tubing about the static ball seat to inhibit fluid flow and the communication of pressure from above the static ball seat to below the static ball seat up to the pressure rating of the plug/plug seat combination. The plug may be amenable to disintegration by a variety of methods, and is preferably dissolvable, according to methods known in the art, or can be drilled out. In this manner the toe can be opened by activating the downhole tool and when the received ball seals about the ball seat the tubing string can be pressure tested up to the fluid pressure.

BRIEF DESCRIPTION OF THE SEVERAL VIEWS OF THE DRAWINGS

FIGS. 1A & 2A are enlarged views of windows 1A and 2A of FIGS. 1 & 2 respectively.

DETAILED DESCRIPTION OF A PREFERRED EMBODIMENT

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracing process, fracing fluids and/or gasses move from the surface in the downwell direction to the portion of the tubing string within the formation.

Figure 1:
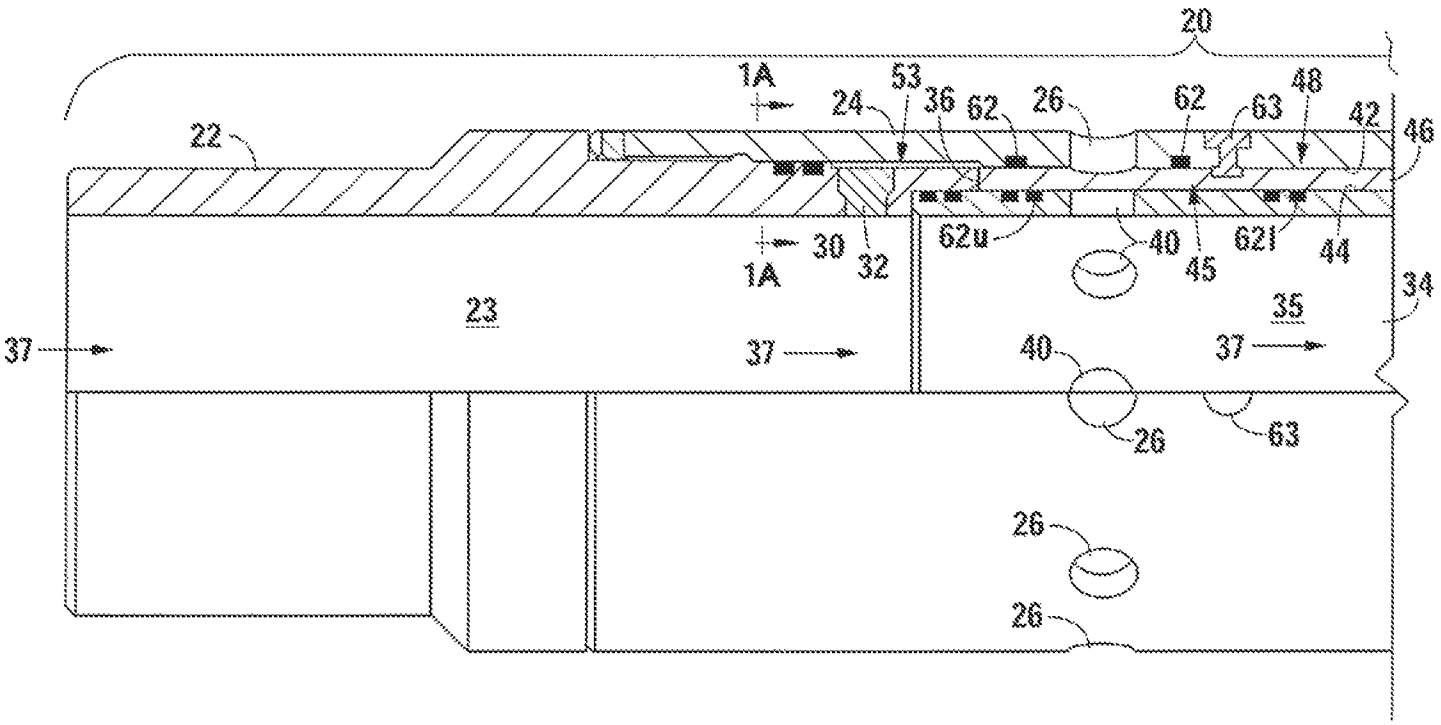
FIGS. 1-2 are partial sectional side elevations of a preferred embodiment in the closed position.
Figure 4B:
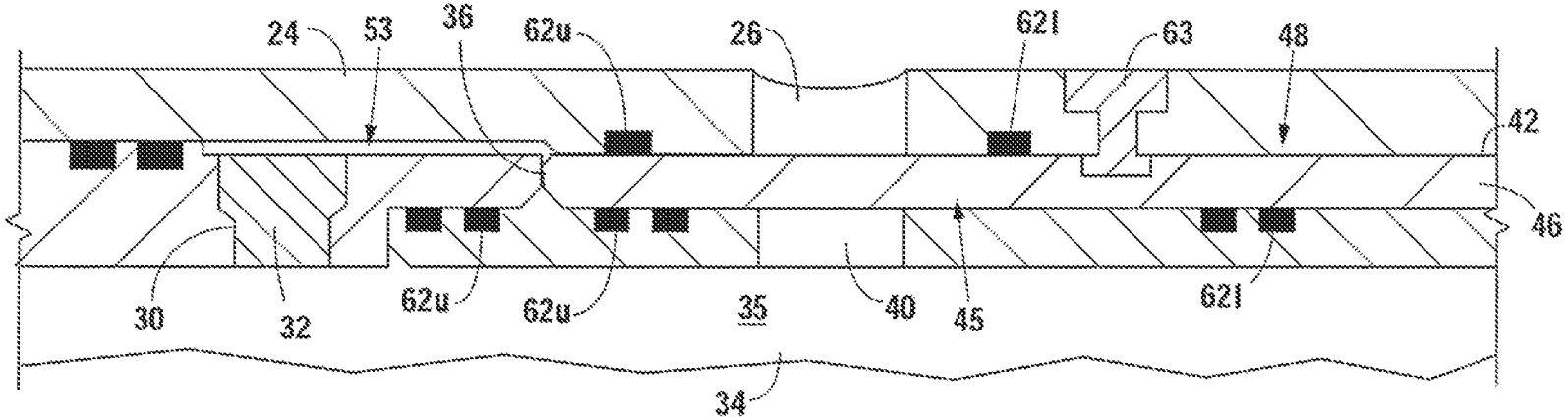
FIGS. 3-4 are partial sectional side elevations of the preferred embodiment in the open position.
Figure 2:
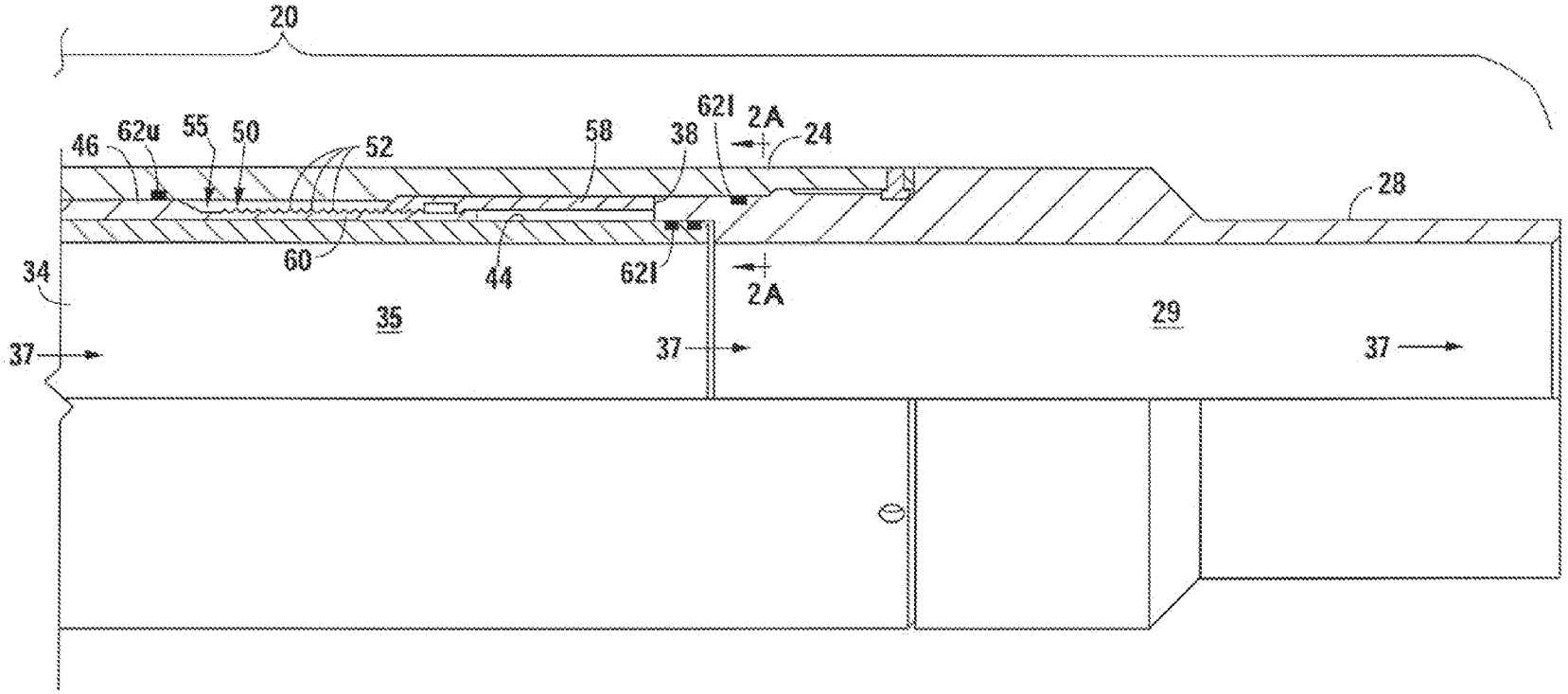
Figure 2B:
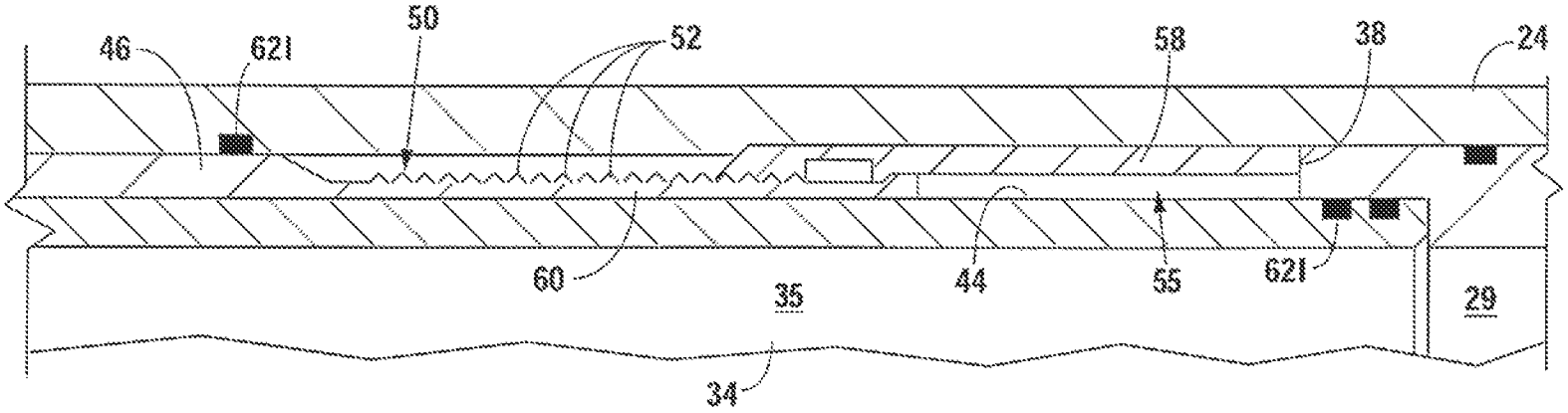

FIGS. 1-2 depict a preferred embodiment 20, which comprises a top connection 22 threaded to a top end of ported housing 24 having a plurality of radially-aligned housing ports 26. A bottom connection 28 is threaded to the bottom end of the ported housing 24. The top and bottom connections 22, 28 having cylindrical inner surfaces 23, 29, respectively. A fluid path 30 through the wall of the top connection 22 is filled with a burst disk 32 that will rupture when a pressure is applied to the interior of the tool 22 that exceeds a rated pressure.

An inner sleeve 34 having a cylindrical inner surface 35 is positioned between a lower annular surface 36 of the top connection 22 and an upper annular surface 38 of the bottom connection 28. The inner sleeve 34 has a plurality of radially aligned sleeve ports 40. Each of the sleeve ports 40 is concentrically aligned with a corresponding housing port 26. The inner surfaces 23, 29 of the top and bottom connections 22, 28 and the inner surface 35 of the sleeve 35 define an interior flowpath 37 for the movement of fluids into, out of, and through the tool. In an alternative embodiment, the interior flowpath may be defined, in whole or in part, by the inner surface of the shifting sleeve.

Although the housing ports 26 and sleeve ports 40 are shown as cylindrical channels between the exterior and interior of the tool 20, the ports 26, 40 may be of any shape sufficient to facilitate the flow of fluid therethrough for the specific application of the tool. For example, larger ports may be used to increase flow volumes, while smaller ports may be used to reduce cement contact in cemented applications. Moreover, while preferably concentrically aligned, each of the sleeve ports 40 need not be concentrically aligned with its corresponding housing port 26.

The top connection 22, the bottom connection 28, an interior surface 42 of the ported housing 24, and an exterior surface 44 of the inner sleeve 34 define an annular space 45, which is partially occupied by a shifting sleeve 46 having an upper portion 48 and a lower locking portion 50 having a plurality of radially-outwardly oriented locking dogs 52.

The annular space 45 comprises an upper pressure chamber 53 defined by the top connection 22, burst disk 32, outer housing 24, inner sleeve 34, the shifting sleeve 46, and upper sealing elements 62*u*. The annular space 45 further comprises a lower pressure chamber 55 defined by the bottom connection 28, the outer housing 24, the inner sleeve 34, the shifting sleeve 46, and lower sealing elements 621. In a preferred embodiment, the pressure within the upper and lower pressure chambers 53, 55 is atmospheric when the tool is installed in a well (i.e., the burst disk 32 is intact).

A locking member 58 partially occupies the annular space 45 below the shifting sleeve 46 and ported housing 24. When the sleeve is shifted, the locking dogs 52 engage the locking member 58 and inhibit movement of the shifting sleeve 46 toward the shifting sleeve's first position.

The shifting sleeve 46 is moveable within the annular space 45 between a first position and a second position by application of hydraulic pressure to the tool 20. When the shifting sleeve 46 is in the first position, which is shown in FIGS. 1-2, fluid flow from the interior to the exterior of the tool through the housing ports 26 and sleeve ports 40 is impeded by the shifting sleeve 46 and surrounding sealing elements 62. Shear pins 63 may extend through the ported housing 24 and engage the shifting sleeve 46 to prevent unintended movement toward the second position thereof, such as during installation of the tool 20 into the well. Although shear pins 63 function in such a manner as a secondary safety device, alternative embodiments contemplate operation without the presence of the shear pins 63. For example, the downhole tool may be installed with the lower pressure chamber containing fluid at a higher pressure than the upper pressure chamber, which would tend to move and hold the shifting sleeve in the direction of the upper pressure chamber.

To shift the sleeve 46 to the second position (shown in FIG. 3-4), a pressure greater than the rated pressure of the burst disk 32 is applied to the interior of the tool 20, which may be done using conventional techniques known in the art. This causes the burst disk 32 to rupture and allows fluid to flow through the fluid path 30 to the annular space 45. In some embodiments, the pressure rating of the burst disk 32 may be lowered by subjecting the burst disk 32 to multiple pressure cycles. Thus, the burst disk 32 may ultimately be ruptured by a pressure which is lower than the burst disk's 32 initial pressure rating.

Figure 3:
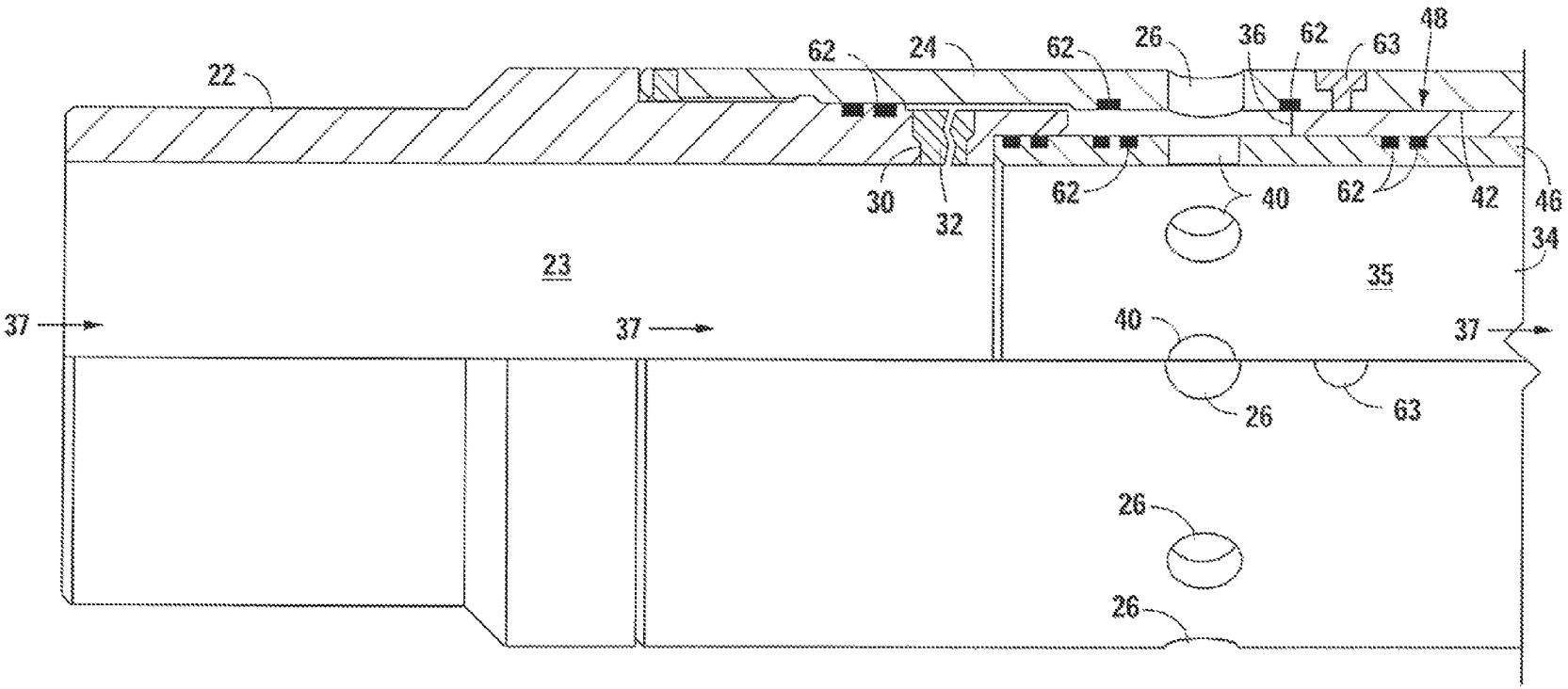
Figure 4:
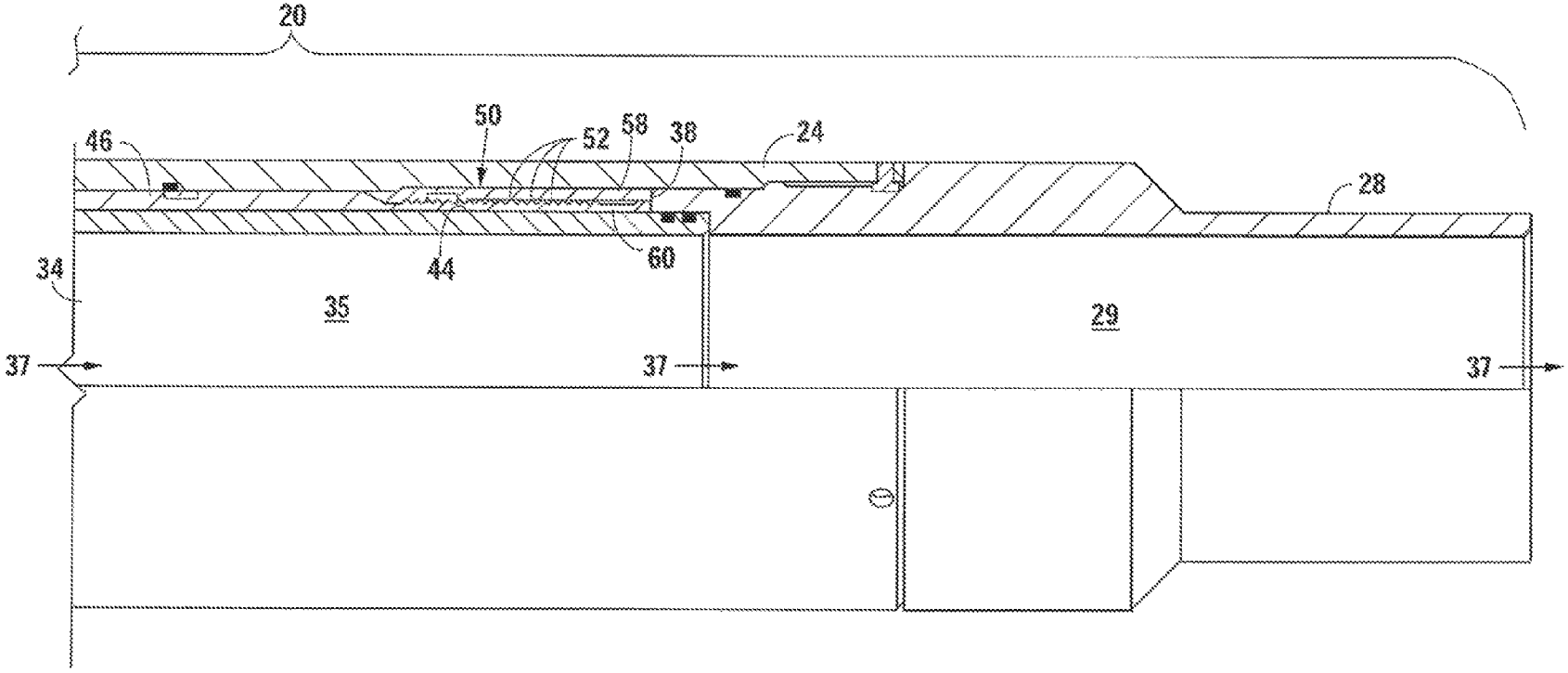

Following rupture of the burst disk 32, the shifting sleeve 46 is no longer isolated from the fluid flowing through the inner sleeve 34. The resultant increased pressure on the shifting sleeve surfaces in fluid communication with the upper pressure chamber 53 creates a pressure differential relative to the atmospheric pressure within the lower pressure chamber 55. Such pressure differential across the shifting sleeve causes the shifting sleeve 36 to move from the first position to the second position shown in FIG. 3-4, provided the force applied from the pressure differential is sufficient to overcome the shear pins 63, if present. In the second position, the shifting sleeve 46 does not impede fluid flow through the housing ports 26 and sleeve ports 40, thus allowing fluid flow between the interior flow path and the exterior of the tool. As the shifting sleeve 46 moves to the second position, the locking member 58 engages the locking dogs 52 to prevent subsequent upwell movement of the sleeve 46.

Figure 5:
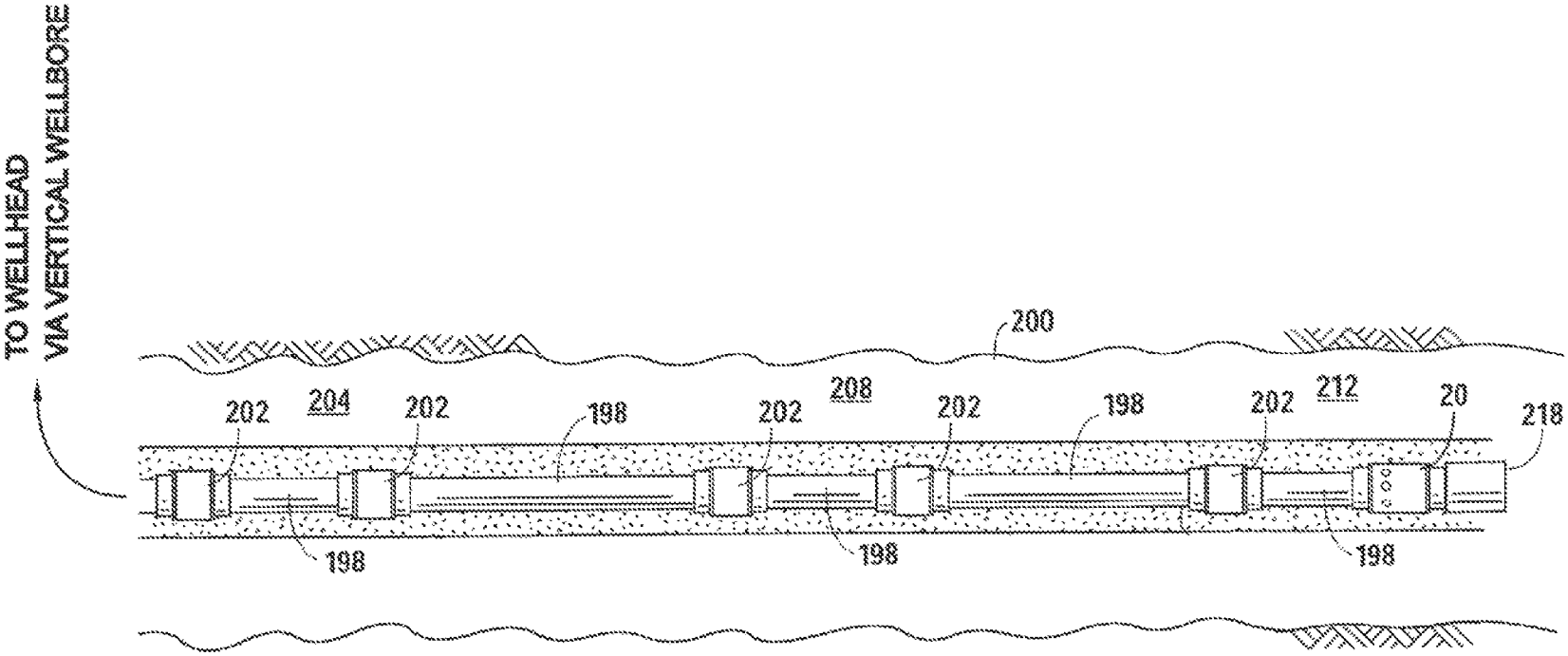
FIG. 5 is a side sectional elevation of a system incorporating an embodiment of the downhole tool described with reference to FIGS. 1-4.

FIG. 5 shows the embodiment described with reference to FIGS. 1-4 in use with tubing 198 disposed into a lateral extending through a portion of a hydrocarbon producing formation 200, with the tubing 198 having various downhole devices 202 positioned at various stages 204, 208, 212 thereof. The tubing 198 terminates with a downhole tool 20 having the features described with reference to FIGS. 1-4 and a plugging member 218 (e.g., bridge plug) designed to isolate flow of fluid through the end of the tubing 198. Initially, the tool 20 is in the state described with reference to FIGS. 1-2.

Prior to using the tubing 198, the well operator may undertake a number of integrity tests by cycling and monitoring the pressure within the tubing 198 and ensuring pressure loss is within acceptable tolerances. This, however, can only be done if the downwell end of the tubing 198 is isolated from the surrounding formation 200 with the isolation member 218 closing off the toe of the tubing 198. After testing is complete, the tool 20 may be actuated as described with reference to FIGS. 3-4 to open the toe end of tubing 198 to the flow of fluids.

Figure 6:
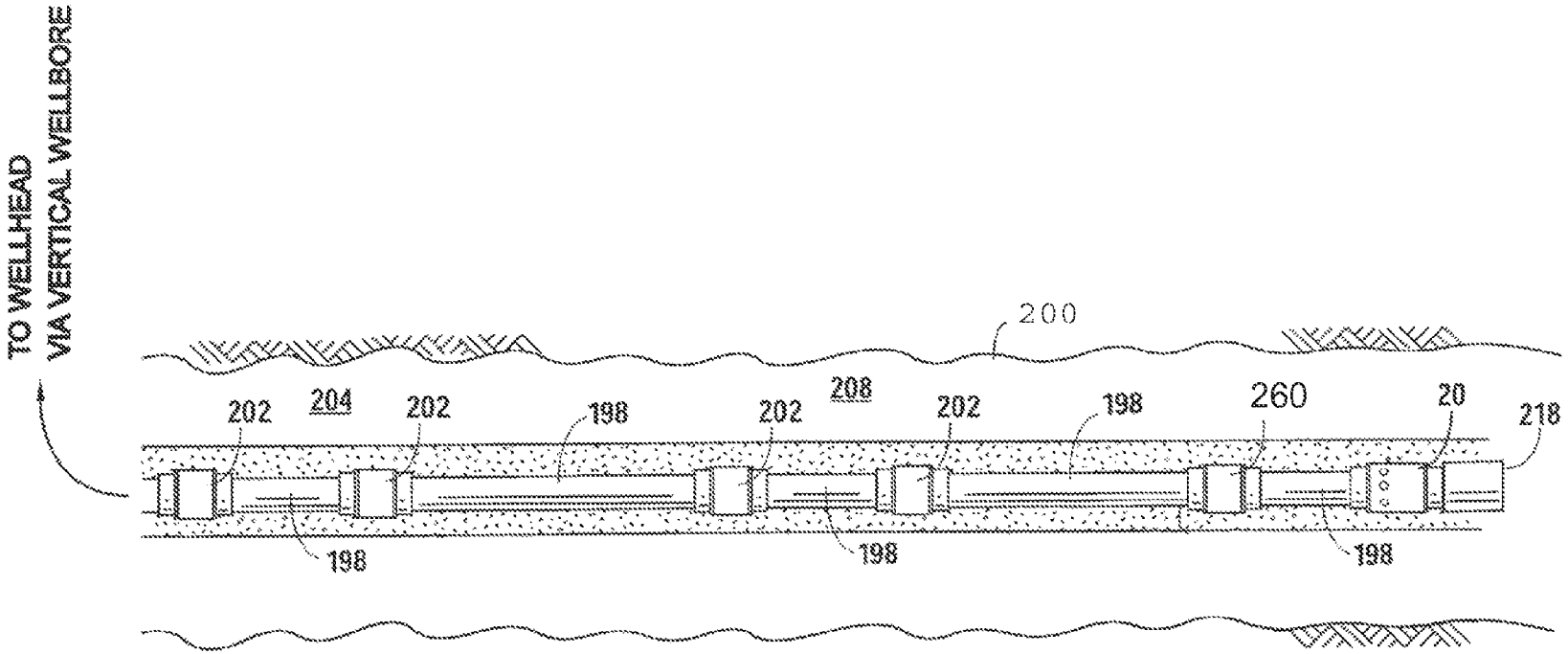
FIG. 6 is a side elevation of another system incorporating an embodiment of the downhole tool described with reference to FIGS. 1-4.
Figure 7:
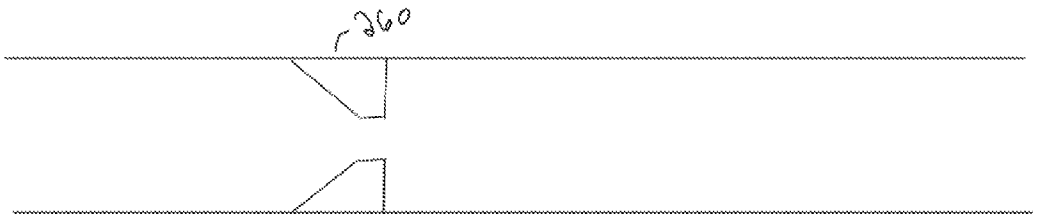
FIG. 7 is a side cross section elevation of a portion of the system shown in FIG. 6 illustrating a static ball seat.
Figure 8:
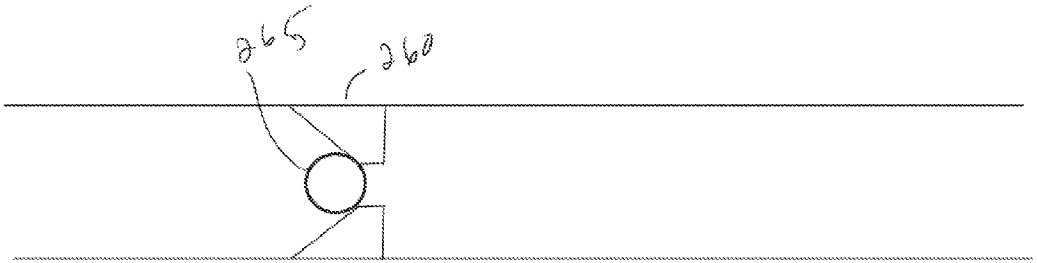
FIG. 8 is a side cross section elevation of a portion of the system shown in FIG. 6 illustrating a static ball seat with a ball seated on the ball seat.
Figure 9:
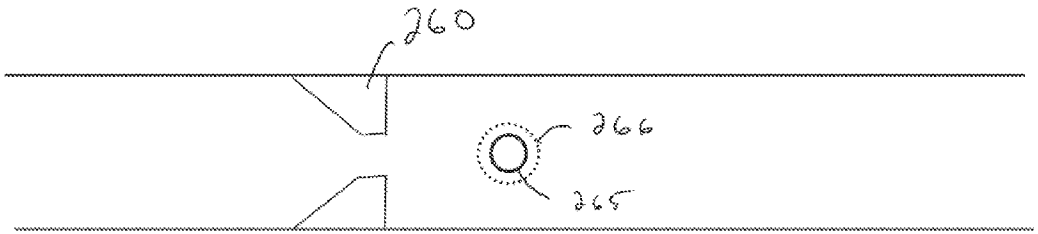
FIG. 9 is a side cross section elevation of a portion of the system shown in FIG. 6 illustrating a static ball seat with a partially disintegrated ball below the static ball seat.

In some situations care must be taken to avoid actuating tool 20 during the tubing integrity tests. In these instances the tubing integrity tests should not equal or exceed the pressure at which tool 20 will actuate otherwise the integrity test may prematurely actuate tool 20. In some instances it may be preferable to perform the integrity tests at pressures above that which will actuate tool 20. FIGS. 6-9 illustrate another aspect of this disclosure and a further embodiment of a system and method that enables the integrity testing to be performed at desired pressures irrespective of the pressure at which tool 20 may actuate. FIG. 6 illustrates tubing 198 in formation 200 with a tool 20 positioned proximal an end of tubing 198. A static ball seat 260, or other plug seat, is positioned above tool 20 in tubing 198 and dimensioned to receive a ball 265, or other appropriate plug, to seal the tubing 198 at the position of the static ball seat 260 to inhibit fluid flow from above the seat 260 to below the seat 260 and the communication of pressure from above the seat 260 to below the seat 260. It will be appreciated that plugs other than balls and corresponding plug seats may be used in conjunction with embodiments of the present disclosures. Ball 265 is preferably dissolvable, degradable, or capable of disintegrating as is known in the art when exposed to an appropriate environment—such as when brought into contact with a solution such as an acid, solvent or brine solution, maintained in an environment of a sufficient temperature for a sufficient length of time, or other treatment—such that the size of the ball is reduced to the point that it is capable of moving through and past ball seat 265 and, preferably, past tool 20 as illustrated in FIG. 9 wherein the original ball circumference is illustrated with dashed line 266. In one embodiment, tubing string 198 with tool 20 and seat 265 is made up and positioned in the wellbore. Tool 20 is then actuated as indicated herein creating a fluid communication path from inside of the tubing 198 into the formation 200. Ball 265 is dropped into the tubing 198 and allowed to contact ball seat 260 and create a seal in tubing 198 at ball seat 260. At this point, integrity tests may be performed on tubing 198. It will be appreciated that the plug and plug seat must be able to withstand the pressure of the desired pressure test and will therefore have a pressure rating that is preferably higher than such test pressure.

Following the pressure test, ball 265 is then allowed to dissolve, disintegrate, degrade or otherwise reduce its size to a point where it may pass through seat 260 and past tool 20. In this manner the tool 20 was actuated to provide a communication flow path and tubing 198 was tested for integrity irrespective of the actuating pressure for tool 20.

Another embodiment of a system and method, allows a string to be run, cemented, tested and be ready for pumping down equipment for later treating.

From bottom up the embodiment may be comprised of:

Either float equipment to catch a wiper dart or a ball seat to catch a wiper ball A Trigger Toe Sub such as tool 20

A static ball seat, or other plug seat, carrier

The equipment would be run in on the desired casing and cemented in place following standard practices. When it comes time to wipe the casing a certain amount of fluid would be pumped ahead of the wiper ball/dart such that when the ball/dart lands at the toe there is sufficient fluid displacing cement on the outside of the casing to provide a "wet shoe", leaving the Trigger Toe sub or tool 20 not cemented.

Cement would be allowed to set up as per standard practices, then pressure would be applied to the casing string to open the Trigger Toe Sub or tool 20. This creates a flowpath allowing a dissolvable ball to be pumped down and seated on the static ball seat carrier above the Trigger Toe Sub or tool 20. At this point the operator can perform pressure testing on their casing as required. Once their testing is complete the ball will dissolve over time such that when the operator returns to perform their follow up work (plug and perf, ball drop frac, etc) the ball has dissolved sufficiently to re-establish the fluid flow path through the Trigger Toe Sub or tool 20.

In certain embodiments, the plug will be selected based on the characteristics of the plug in relation to the selected plug seat. Factors in plug selection will include the pressure differential the plug can withstand and the disintegration time of the plug in the particular wellbore environment. For example, the Fastball™ sold by Magnum Oil Tools can withstand a pressure differential across the ball of over 12,000 psi when a 2 inch Fastball™ is engaged on a ball seat having an inner passage of diameter 1.875 inches. At 250° F., the Fastball will lose 0.125 inches of diameter, and thereby become smaller than the opening in 1.875 inch ball seat, in approximately 4 hours. The Fastball™ may extrude through the ball seat in less than four hours, depending on the pressure applied and maintained. Similarly at 300° F., the Fastball™ will lose 0.125 inches from its diameter in less than an hour. Thus, the higher the temperature, the shorter the available window for conducting the desired pressure test. Thus, by knowing the temperature of the formation adjacent the plug seat, a plug and plug seat combination can be chosen to withstand a desired pressure differential across the plug and plug seat for a minimum period of time before disintegration.

It will also be appreciated that the pressure rating of various ball and ball seat combinations can be determined empirically through methods known in the art. For example, a 2 inch ball can placed in a test assembly with a 1.8125 inch ball seat and seat on the ball seat. Pressure may then be applied to the ball side of the test assembly in increments until the seal between the ball and ball seat fails to establish the maximum pressure which the ball and ball seat combination can withstand. Multiple tests can be run to determine an average rating value. Alternatively, if a ball and ball seat combination, e.g. a 2 inch ball with a 1.875 inch opening ball seat, has a known rating, a larger ball, such as 2.125 inch ball may be used initially to create the seal and perform the pressure test. Such ball and ball seat will hold to the pressure for which a 2 inch ball is rated until the ball disintegrates to a diameter smaller than 2 inches.

Different operators of wells have differing preferences for the length of the desired pressure test. Further, regulatory bodies may promulgate rules defining the length of required pressure tests. Preferred times of at least 10 minutes, at least 15 minutes, between 15 and 30 minutes, more than minutes, and at least an hour are currently known in the art. The current system allows for selection of plugs and plug seats to permit these and longer pressure tests provided an appropriate sized plug of the appropriate material is placed in the proper environment.

It may also be possible to perform this procedure without the need for the wet shoe. Also the static ball seat 260 may be of any type of ball seat that receives the ball and engages with the ball to withstand pressures from above the ball seat.

The downhole tool may be placed in positions other than the toe of the tubing, provided that sufficient internal flowpath pressure can be applied at a desired point in time to create the necessary pressure differential on the shifting sleeve. In certain embodiments, the internal flowpath pressure must be sufficient to rupture the burst disk, shear the shear pin, or otherwise overcome a pressure sensitive control element. However, other control devices not responsive to pressure may be desirable for the present device when not installed in the toe.

The downhole tool as described may be adapted to activate tools associated with the tubing rather than to open a flow path from the interior to the exterior of the tubing. Such associated tools may include a mechanical or electrical device which signals or otherwise indicates that the burst disk or other flow control device has been breached. Such a device may be useful to indicate the pressures a tubing string experiences at a particular point or points along its length. In other embodiments, the device may, when activated, trigger release of one section of tubing from the adjacent section of tubing or tool. For example, the shifting element may be configured to mechanically release a latch holding two sections of tubing together. Any other tool may be used in conjunction with, or as part of, the tool of the present disclosure provided that the inner member selectively moves within the space in response to fluid flow through the flowpath 30. Numerous such alternate uses will be readily apparent to those who design and use tools for oil and gas wells.

The illustrative embodiments are described with the shifting sleeve's first position being "upwell" or closer to the wellhead in relation to the shifting sleeve's second position, the downhole tool could readily be rotated such that the shifting sleeve's first position is "downwell" or further from the wellhead in relation to the shifting sleeve's second position. In addition, the illustrative embodiments provide possible locations for the flow path, fluid control device, shear pin, inner member, and other structures, those or ordinary skill in the art will appreciate that the components of the embodiments, when present, may be placed at any operable location in the downhole tool.

The present disclosure includes preferred or illustrative embodiments in which specific tools are described. Alternative embodiments of such tools can be used in carrying out the invention as claimed and such alternative embodiments are limited only by the claims themselves. Other aspects and advantages of the present invention may be obtained from a study of this disclosure and the drawings, along with the appended claims.

We claim:

1. A downhole system including a tool having an interior flowpath and an exterior, the downhole system comprising:
- the tool comprising:
  - an inner sleeve;
  - a housing positioned outwardly of said inner sleeve, said housing and said inner sleeve partially defining a first space therebetween;
  - a shifting sleeve occupying a portion of said space;
  - said space in fluid isolation from the interior flowpath and comprising an upper pressure chamber at least partially defined by said shifting sleeve; and
- a plug seat positioned proximally above said downhole tool and capable of receiving a plug to prevent fluid communication through the plug seat to the downhole tool;
- wherein said shifting sleeve has a first position in which the shifting sleeve prevents fluid communication between the interior flowpath and the exterior and a second position wherein the shifting sleeve does not prevent fluid communication between the interior flowpath and the exterior.

2. The downhole system of claim 1 further comprising a plug engaged on said plug seat and wherein the shifting sleeve is in the second position.

3. The downhole system of claim 2 further comprising an environment for at least partial disintegration of the plug, wherein the at least partial disintegration of the plug permits fluid communication between the plug seat and the exterior.

4. The downhole system of claim 2 wherein the plug disintegrates sufficiently to allow fluid communication to the downhole tool in a time more than one hour after the plug engages the plug seat.

5. The downhole system of claim 2 wherein the plug disintegrates sufficiently to allow fluid communication to the downhole tool in a time between 10 minutes and one hour from the time the plug engages the plug seat.

6. The downhole system of claim 2 wherein the plug disintegrates sufficiently to allow fluid communication to the downhole tool in a time more than thirty minutes after the plug engages the plug seat.

7. The downhole system of claim 1, the tool further comprising a fluid control device having a first state preventing fluid communication between the interior flowpath and the upper pressure chamber and a second state permitting fluid communication between the interior flowpath and the upper pressure chamber.

8. The downhole system of claim 7 wherein the fluid control device comprises a burst disk.

9. A method for treating a well for oil, gas, or other hydrocarbons, said well containing a system, the system comprising:

a tool having an interior flowpath and an exterior, the device comprising an outer housing, said housing having at least one port therethrough;

at least one shifting sleeve mounted within the tubing, said shifting sleeve having a first position and a second position;

a pressure chamber in fluid communication with said at least one shifting sleeve;

wherein, the interior flowpath is not in fluid communication with the exterior when the shifting sleeve is in the first position, and the interior flowpath is in fluid communication with the exterior when the shifting sleeve is in the second position;

a plug seat positioned upstream of the downhole tool;

the method comprising increasing fluid pressure in the interior flowpath to move the shifting sleeve to the second position;

pumping a fluid into the plug seat, said fluid comprising a plug configured to create a fluid seal with said plug seat, thereby engaging the plug with said plug seat;

wherein the environment in the tubing adjacent to the plug seat causes the plug to reduce in size;

pumping fluid through the plug seat after the plug has disintegrated sufficiently.

10. The method of claim 9 further comprising fracturing a subterranean formation upwell of said plug seat.

11. The method of claim 9 further wherein the environment of the plug seat reduces the size of said plug sufficiently to allow fluid communication through said plug seat from between 10 minutes to one hour after engagement of the plug on the plug seat.

12. The method of claim 9 further wherein the environment of the plug seat reduces the size of said plug sufficiently to allow fluid communication through said plug seat more than one hour after engagement of the plug on the plug seat.

13. The method of claim 9 further wherein the plug is configured to hold a desired test pressure after the plug has partially disintegrated.

14. The method of claim 9 wherein the plug is a ball and the plug seat is a ball seat.

15. A downhole system including a tool having an interior flowpath and an exterior, the downhole system comprising:

the tool comprising:

an inner sleeve;

a housing positioned outwardly of said inner sleeve, said housing and said inner sleeve partially defining a first space therebetween; and a shifting sleeve occupying a portion of said space;

said space in fluid isolation from the interior flowpath and the exterior and comprising a lower pressure chamber at least partially defined by the shifting sleeve;

and a plug seat positioned proximally above said down hole tool and capable of receiving a plug to prevent fluid communication through the plug seat to the downhole tool;

wherein said shifting sleeve has a first position in which the shifting sleeve prevents fluid communication between the interior flowpath and the exterior and a second position wherein the shifting sleeve does not prevent fluid communication between the interior flowpath and the exterior.

16. The downhole system of claim 15 wherein the space further comprises an upper pressure chamber at least partially defined by the shifting sleeve.

17. The downhole system of claim 15 further comprising a plug configured to create a fluid seal with the plug seat.

18. The downhole system of claim 17 wherein the plug reduces in size in response to the environment adjacent to the plug seat.

19. The downhole system claim 17 wherein the plug comprises material that reduces in size, at least in part, in response to temperature.

* * * * *